United States Patent [19]

Domoto et al.

[11] Patent Number: 5,063,413

[45] Date of Patent: Nov. 5, 1991

[54] REMOVAL OF EXCESS LIQUID FROM AN IMAGE RECEPTOR

[75] Inventors: Gerald A. Domoto; Aron Sereny, both of Briarcliff Manor, N.Y.

[73] Assignee: Xerox Corporation, Stamford, Conn.

[21] Appl. No.: 560,814

[22] Filed: Jul. 31, 1990

[51] Int. Cl.[5] ..... G03G 21/00

[52] U.S. Cl. ..... 355/296; 118/652; 355/256; 430/125; 134/21

[58] Field of Search ..... 355/256, 296, 307; 118/652, 659–662; 430/125, 39; 134/1, 9, 21, 15; 15/300.1, 302

[56] References Cited

U.S. PATENT DOCUMENTS

| | | | |
|---|---|---|---|
| 3,536,528 | 10/1970 | de Geest . | |
| 3,654,659 | 4/1972 | Blumenthal | 15/309.1 |
| 3,741,643 | 6/1973 | Smith et al. . | |
| 3,811,765 | 5/1974 | Blake . | |
| 4,014,065 | 3/1977 | Hudson . | |
| 4,026,701 | 5/1977 | Till et al. | 15/309.1 |
| 4,067,018 | 1/1978 | Pond . | |
| 4,121,947 | 10/1978 | Hemphill . | |
| 4,181,094 | 1/1980 | Gardiner . | |
| 4,202,073 | 5/1980 | Hughes | 15/309.1 |
| 4,259,006 | 3/1981 | Phillips et al. | 118/662 X |
| 4,260,235 | 4/1981 | Stack . | |
| 4,271,559 | 6/1981 | Blumenthal | 15/308 |
| 4,522,488 | 6/1985 | Fisher | 15/309.1 |
| 4,721,661 | 1/1988 | Olson et al. . | |
| 4,797,708 | 1/1989 | Kasiske, Jr. et al. . | |
| 4,878,090 | 10/1989 | Lunde | 355/256 |

*Primary Examiner*—R. L. Moses

*Attorney, Agent, or Firm*—Oliff & Berridge

[57] ABSTRACT

A method and apparatus is described for removing excess liquid from an image receptor. As the image receptor moves at a certain velocity in one direction, a vacuum source or a source of positive air pressure effects air flow in a direction parallel to and opposite that of image receptor movement. The air flow is effected at a velocity greater than that of the image receptor movement. A channel is defined adjacent the receptor surface in which a pressure gradient is established for driving the air flow and causing the liquid layer to thin.

20 Claims, 3 Drawing Sheets

REMOVAL OF EXCESS LIQUID FROM AN IMAGE RECEPTOR

BACKGROUND OF THE INVENTION

1. Field of the Invention

The present invention relates to a device for removing excess liquid from an image receptor and, more particularly, to a device for removing excess liquid after an image on an image receptor has been developed using liquid development techniques.

2. Description of the Related Art

In one liquid development technique, an image receptor having a photoconductive surface is moved past: 1) a charging station at which the receptor surface is provided with an electrostatic charge; 2) an exposure station at which the receptor surface is exposed to a light image of an original selectively to discharge the surface and form an electrostatic image; 3) a developing station at which a liquid developer is applied to the surface to form a toner particle image on the surface; and 4) a transfer station at which the developed image is transferred to a sheet of paper. The toner, or colorant, applied at the developing station is held to the image areas by electrostatic or other surface forces. A liquid layer remains both on the image and on the background areas. The excess liquid often results in damp or stained paper copies. Excess liquid also creates a problem in other liquid development techniques such as, for example, the ionographic and ion deposition techniques.

Various techniques have been developed to remove excess developer material without disturbing the delicate developed image on the photoconductive surface.

U.S. Pat. No. 4,181,094 to Gardiner discloses an apparatus for removing excess liquid developer from the surface of a photoconductor carrying a layer of developer liquid of a predetermined thickness. A mechanical barrier member formed with a slot extends across the photoconductive surface and is in close relationship to the surface with a gap between the barrier member and the surface which is less than the thickness of the developer layer. Low pressure air is supplied through the slot to form an air pressure barrier in the region between the barrier member and the photoconductive surface which prevents the passage of a relatively thick layer of developer liquid. A sponge pad is used to wipe the barrier member for the removal of developer liquid and for the prevention of toner deposit buildup which may be present.

U.S. Pat. No. 4,014,065 to Hudson discloses a vacuum removal device for removing excess developer material from a member having a latent image developed with magnetic developer material. The vacuum comprises a chamber having inlet and outlet ports sufficiently small to ensure substantially uniform air flow. The inlet port is in communication with a means for effecting a uniform shearing air flow across the developer material on the latent image member, thereby removing developer material from background portions of the latent image member. The cross-sectional area of the inlet port can be varied to meet varying air flow requirements.

U.S. Pat. No. 4,067,018 to Pond discloses a displacement system which removes excessive magnetic developer material from the vicinity of a latent image by application of air streams along the developed surface of the image. The system uses a vacuum assembly. A centrifugal force is applied to the image surface to displace excess particles. Particle-laden air flow moves in a path substantially parallel to and opposite to the path of travel of the image surface.

U.S. Pat. No. 4,721,661 to Olson et al discloses a vacuum device for selectively removing excess toner from an image member. The device minimizes tangential air flow across the surface of the image member by using a suction device terminating in lips whose terminal face along an edge are parallel to one another.

U.S. Pat. No. 4,797,708 to Kasiske, Jr. et al discloses an apparatus for scavenging unwanted particles from a photoconductor of an electrographic device. The particles are removed by a vacuum system including a plenum having an inlet opening closely adjacent the surface of the photoconductor. The plenum is mounted for movement toward and away from the photoconductor so that it closely follows photoconductor movement and precisely maintains its position with respect thereto.

U.S. Pat. No. 3,536,528 to De Geest discloses an electrostatic cleaner which removes fine particles from flexible sheet material. The cleaner is primarily used with photographic film for removing fine particles by electrically charging the surface of the sheet and removing the particles by air currents produced by a suction or blowing device. The air currents impinge obliquely onto one surface of the sheet material. A stream of pressurized air is provided to an opposite sheet surface. This stream becomes laden with particles and is carried off through a channel.

U.S. Pat. No. 4,121,947 to Hemphill discloses a method of cleaning a photoreceptor by exposing a photoconductive layer of the photoreceptor to light, charging the layer, vibrating the photoreceptor to dislodge toner and subjecting the dislodged toner to a force, either vacuum or gravity, to draw the toner away from the photoreceptor U.S. Pat. No. 4,260,235 to Stack discloses a contamination prevention system which includes a vacuum scavenging chamber which establishes a venturi to remove toner particles entrained in a boundary layer.

While the related art recognizes that air pressure can be effective in removing excess developer material, the art does not recognize the advantages of driving the air flow with sufficient speed through a channel adjacent to the receptor surface to create a pressure gradient for enhancement of the removal of excess developer material.

OBJECTS AND SUMMARY OF THE INVENTION

Accordingly, one object of the present invention is to remove excess liquid from a liquid developed image receptor without disturbing the developed image.

Another object of the present invention is to remove excess liquid from a liquid developed image receptor without providing damp or stained copies.

Another object of the present invention is to remove excess liquid from a liquid developed image receptor without requiring contact on the image area.

Another object of the present invention is to remove excess liquid from a liquid developed image receptor within extremely stringent dimensional tolerances.

A further object of the present invention is to remove excess liquid from a liquid developed image receptor in an extremely simple manner without stringent dimensional tolerances and in a self-compensating manner.

To achieve the foregoing and other objects, and to overcome the shortcomings discussed above, an apparatus is provided which effectively removes excess liquid from a liquid developed image receptor. As the image receptor moves at a certain velocity in one direction, a vacuum source or a source of positive air pressure effects air flow in a direction parallel to and opposite that of image receptor movement The air flow is effected at a velocity greater than that of the image receptor movement. A channel is formed adjacent the receptor surface, a pressure gradient being formed within the channel to drive the air flow and to cause the liquid layer to thin.

BRIEF DESCRIPTION OF THE DRAWINGS

The invention will be described in detail with reference to the following drawings in which like reference numerals refer to like elements and wherein.

BRIEF DESCRIPTION OF THE PREFERRED EMBODIMENTS

Figure 1:
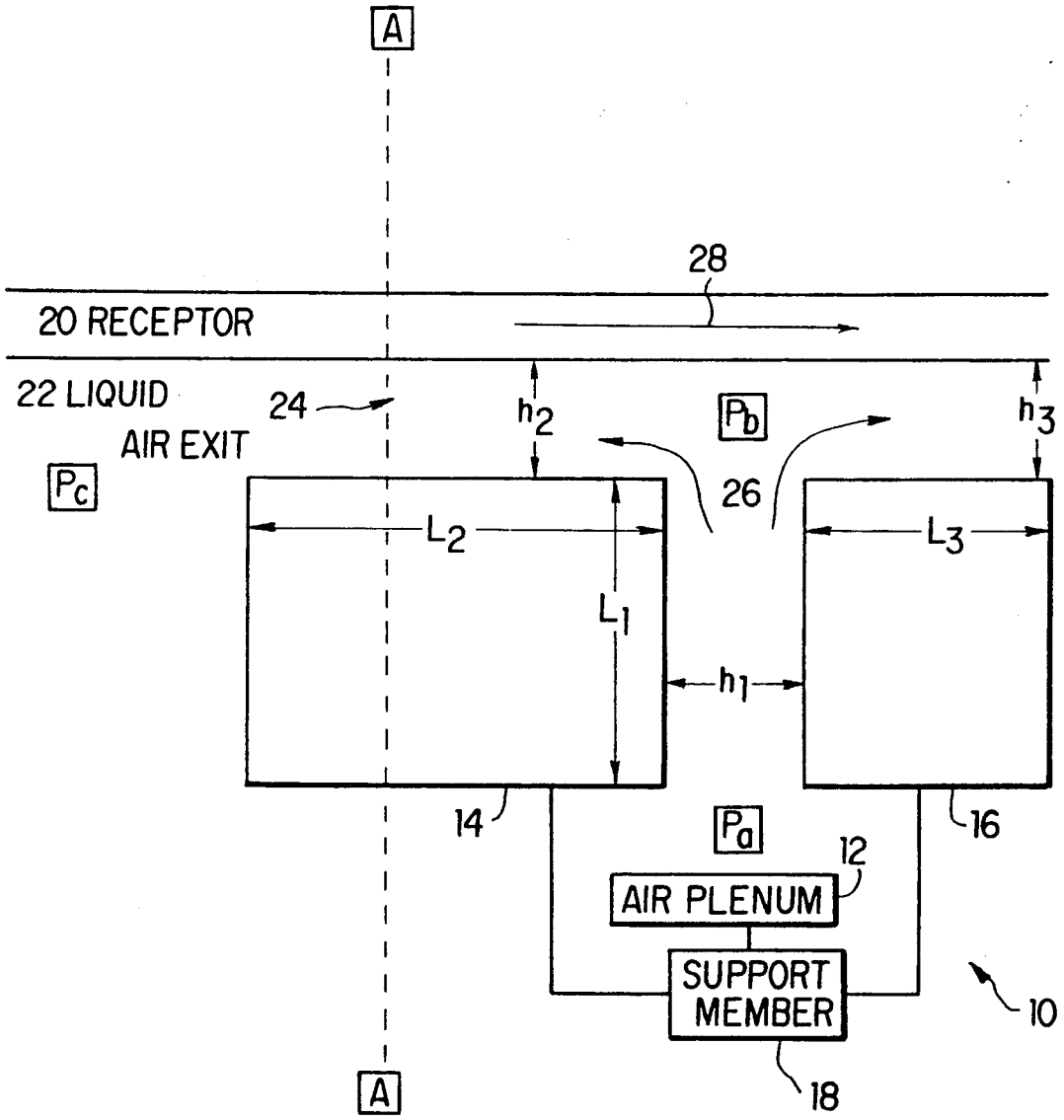
FIG. 1 is a schematic diagram of a positive pressure excess liquid removal device according to the present invention.

Referring now to the drawings and particularly to FIG. 1 thereof, there is shown a device for removing excess developer liquid from an image receptor surface by the application of a positive air pressure. Positive pressure device 10 includes an air plenum 12 which provides a source of air or gas flow. Members 14 and 16 are solid blocks which define a flow path for the air or gas supplied by air plenum 12. Air plenum 12 and members 14 and 16 are supported by a member 18 so as to form an assembly which defines a channel 24 located between device 10 and a surface of image receptor 20 having excess liquid 22 located thereon.

Members 14 and 16 of device 10 comprise blocklike members having uninterrupted surfaces which define a flow path for air expressed from air plenum 12. The dimensions of members 14 and 16 and the spacing between member 14, member 16 and the surface of image receptor 20 having the excess liquid 22 located thereon all cooperate to provide a flow of air which impinges on the surface of receptor 20 with a shearing action resulting in motion in outer portions of liquid 22. The shearing action produced is illustrated by arrow 26. It is noted that air flow in the direction of $h_3$ is minimal due to a pressure gradient in channel 24 discussed below. The flow of air is driven in a direction opposite that of movement of image receptor 20 illustrated at arrow 28.

Air plenum 12 expresses air at a first pressure $P_a$. As the air moves through gap $h_1$ between member 14 and member 16, a reduction in air pressure, $P_b$, results. As the air flow moves through gap $h_2$, a further reduction in air pressure results before the air and excess liquid 22 exits at atmospheric pressure, $P_c$. The pressure gradient resulting from air flow moving through gaps $h_1$ and $h_2$ drives the countercurrent air flow and further causes the excess liquid 22 to thin, thereby facilitating its removal. Variations in the dimensions of members 14 and 16, i.e., $L_1$, $L_2$ and $L_3$, would operate to control the pressure gradient and velocity of air flow as it impinges on the surface of image receptor 20. The device can therefore be adapted for use with devices having varying dimensional tolerances, different inks, different paper, etc. In addition to the ability to vary the dimensions of members 14 and 16, the air pressure from air plenum 12 can be controlled to effect controlled removal of excess liquid 22 from the surface of receptor 20. Plenum pressures on the order of 1 to 2 psi or less are commonly used to remove excess liquid 22 from the surface of receptor 20 which has been developed with liquid toner at a process speed of 2 ips (impressions per second).

Typical dimensions used in the FIG. 1 embodiment can be as follows:

| | |
|---|---|
| $L_1$ = 0.25 in. | $h_1$ = 0.010 in. |
| $L_2$ = 0.25 in. | $h_2$ = 0.006 in. |
| $L_3$ = 1.478 in. | $h_3$ = 0.006 in. |

As described above, these dimensions can be varied in accordance with the particular dimensional tolerances, ink, paper, etc.

Figure 2:
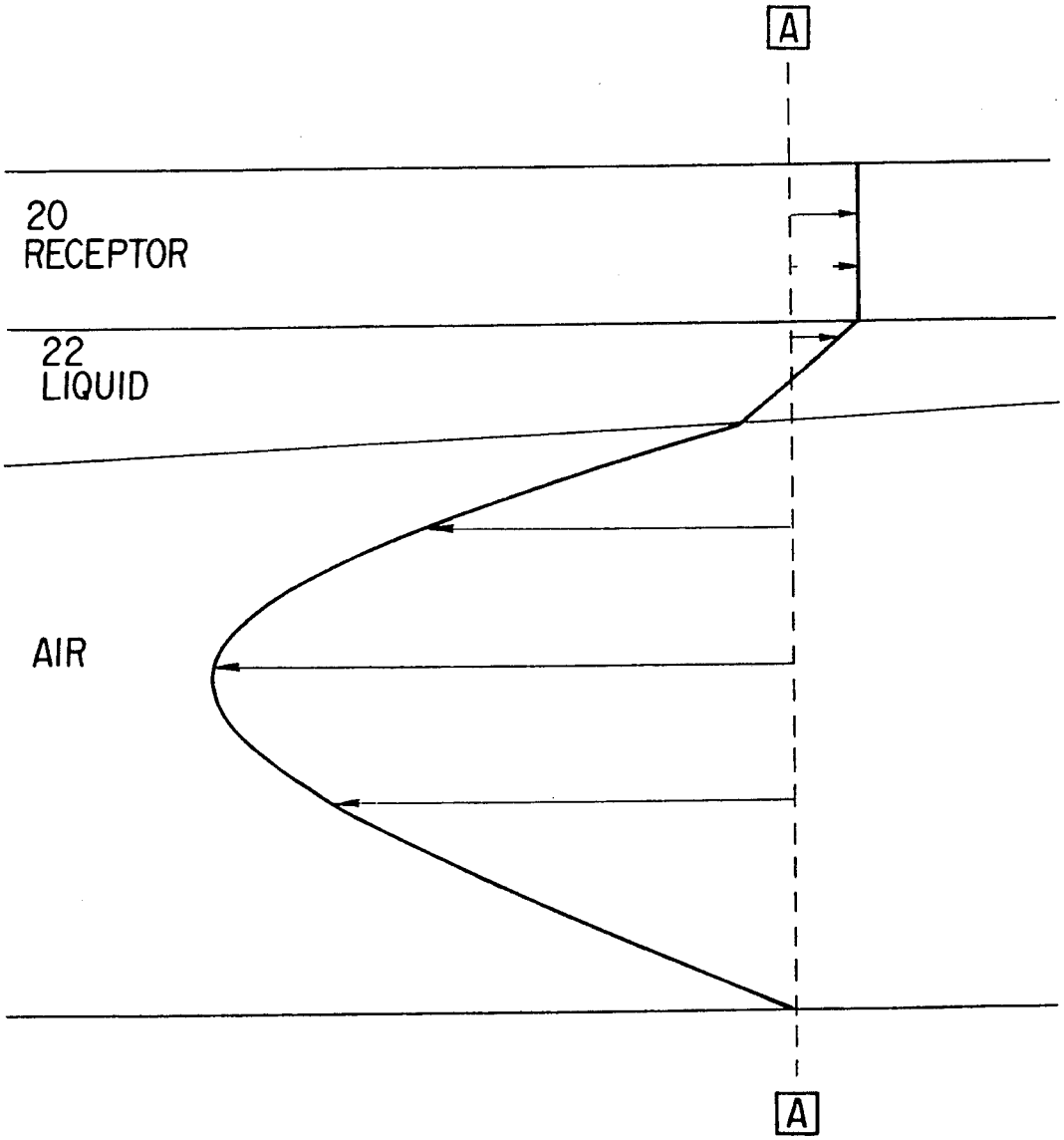
FIG. 2 is a graph of the velocity distribution of the image receptor, liquid layer and air flow along line A—A through FIG. 1.

FIG. 2 illustrates a velocity distribution along line A—A of FIG. 1. As receptor 20 moves towards the right as indicated by the upper arrows of FIG. 2, air supplied from air plenum 12 moves towards the left as indicated by the lower arrows of FIG. 2. At approximately the mid point of gap $h_2$, the air velocity is at a maximum. Liquid layer 22 located on receptor 20 includes a portion which adheres to receptor 20 and a portion which is removed by air flow through channel 24 adjacent the liquid layer 22.

In designing device 10, the main area of concern is the variation of gap $h_2$. Assuming small variations in this dimension over a length scale of $L_2$ illustrated in FIG. 1, quasi one-dimensional approximations can be used. The presence of liquid in gap $h_2$ is neglected for design purposes. As the velocity of receptor 20 is much smaller than the air velocity through channel 24, the velocity of receptor 20 is also neglected. Under these conditions, device 10 can be designed to be self-compensating for variations in dimension $h_2$. For small variations in gap $h_2$, the shear stress that the surface of liquid 22 experiences can be held constant by proper design because the shear stress is proportional to the product of gap and streamwise pressure gradient. If, at a certain location, gap $h_2$ is slightly small, then device 10 should compensate by providing a larger pressure gradient For the simplest design case of $h_2=h_3$ and $L_2=L_3$, analysis shows that the system is self compensating for the following condition:

$$(h_1/h_2)^3 (L_2/L_1)=4.$$

Figure 3:
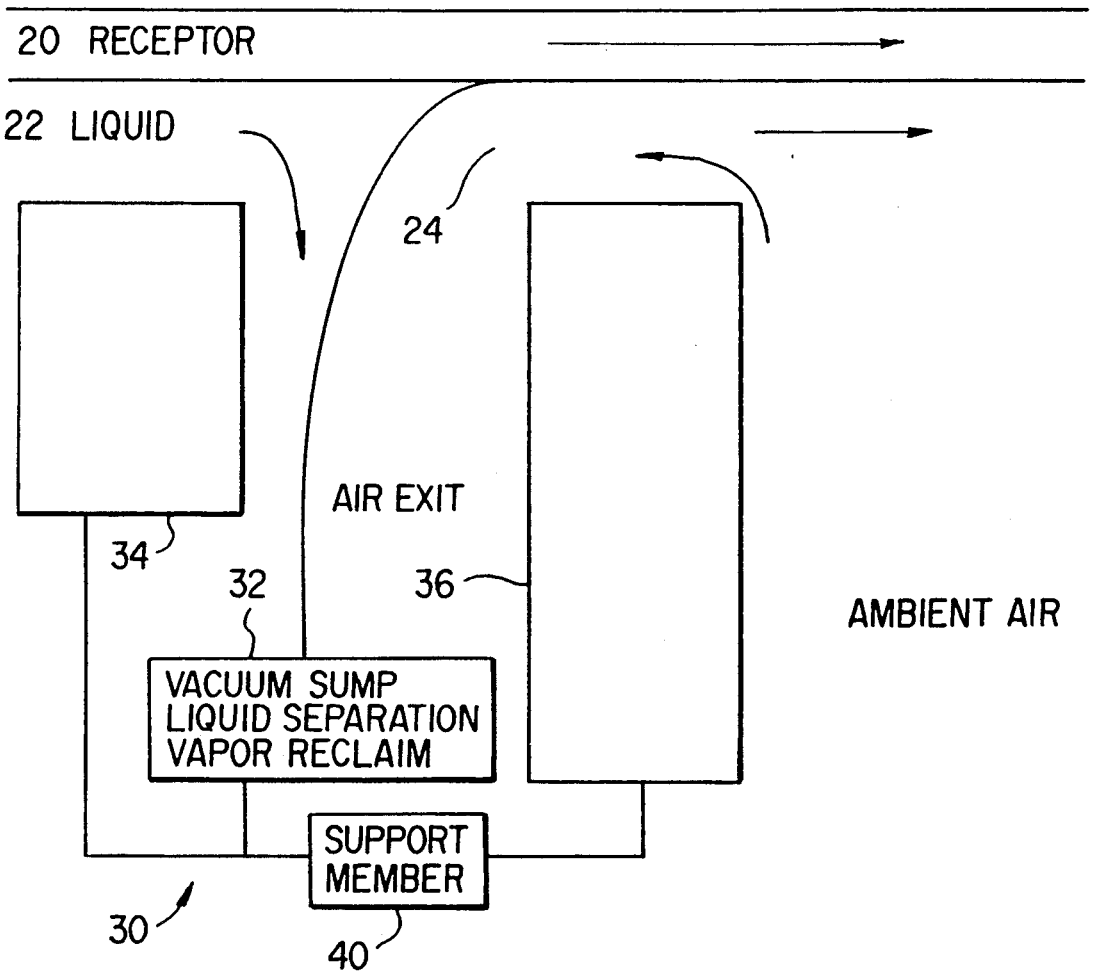
FIG. 3 is a schematic diagram of a negative pressure excess liquid removal device according to the present invention.

FIG. 3 illustrates an air shear device 30 using a vacuum for effecting air flow through channel 24. The device includes two block-like members 34 and 36. These members, like members 14 and 16 of FIG. 1, have uninterrupted outer surfaces to define flow paths for the movement of air. Support member 40 maintains members 34 and 36 and a vacuum sump/liquid separation/-vapor reclaim device 32 in position relative to one another. Device 32 provides a vacuum source for drawing ambient air through the flow paths defined by members 34 and 36. As the air moves through the flow paths, a pressure gradient is formed in much the same manner as positive pressure device 10. The vacuum source is adjustable to control the velocity of air moving through the flow paths. The relative positions of members 34 and 36 are also adjustable to change the flow path dimensions, thereby changing the air flow velocity and pressure gradient in channel 24.

An additional feature of device 30 is the liquid separation/vapor reclaim feature of device 32. This offers the advantage of drawing liquid 22 from receptor 20 into a collection sump. The liquid can either be reused or disposed of in a convenient manner. The release of toner liquid into the ambient air environment is therefore avoided. Device 32 further provides a convenient means of reclaiming vapor produced by evaporation of liquid 22.

It is thus seen that the device according to the present invention effectively removes excess liquid after an image on an image receptor has been developed using liquid development techniques. The device provides a controllable means of removing the excess liquid without requiring solid contact on the image area and while avoiding extremely stringent dimensional tolerances. The excess liquid can be collected to prevent its release into the environment and to enable its reuse.

While this invention has been described in conjunction with specific embodiments thereof, it is evident that many alternatives, modifications and variations will be apparent to those skilled in the art. For example, a liquid separation/vapor reclaim device could be provided with a positive pressure device according to the present invention. The vacuum source device could include two block-like members to define the channel through which countercurrent air flow is driven for the removal of excess liquid. Accordingly, the preferred embodiments of the invention as set forth herein are intended to be illustrative, not limiting. Various changes may be made without departing from the spirit and scope of the invention as defined in the following claims.

What is claimed is:

1. An apparatus for removing excess liquid from a surface of an image receptor, comprising:

means for effecting air flow in a direction substantially parallel to and opposite the direction of movement of the image receptor, said air flow being effected at a velocity greater than the velocity of movement of said image receptor, said effecting means applying a shearing action to a surface of said image receptor to remove any excess liquid present thereon, said effecting means including members defining flow paths for passage of air and excess liquid, said effecting means being self-compensating so that dimensions of the flow paths can be varied without affecting the applied shearing action.

2. The apparatus as recited in claim 1, wherein:

said means for effecting air flow includes a positive pressure device.

3. The apparatus as recited in claim 1, wherein:

said means for effecting air flow comprises a vacuum device.

4. The apparatus as recited in claim 3, wherein:

said vacuum device is connected to a collection reservoir.

5. The apparatus as recited in claim 1, wherein:

said effecting means defines a channel adjacent said image receptor through which said air flow is effected, and said effecting means creates a pressure gradient in said channel for driving the air flow and for thinning the excess liquid.

6. A method for removing excess liquid from the surface of an image receptor, comprising the steps of:

moving a liquid-developed image receptor in one direction at a certain velocity;

effecting air flow in a direction substantially parallel to and opposite that of receptor movement, said effecting being performed in predefined channels at a velocity greater than the velocity of movement of said image receptor and in a self-compensating manner such that dimensions of said predefined channels can be varied without affecting the applied shearing action; and by effecting said air flow, applying a shearing action to a surface of said image receptor for removing any excess liquid present thereon.

7. The method as recited in claim 6, further comprising:

positioning a positive air-pressure source adjacent said receptor surface to cause said air flow to be effected.

8. The method as recited in claim 6, further comprising:

positioning a vacuum adjacent to said receptor surface to cause said air flow to be effected.

9. The method as recited in claim 8, further comprising:

collecting the excess liquid removed by the air flow.

10. The method as recited in claim 6, further comprising:

providing a channel adjacent said receptor surface through which said air flow is effected, and creating a pressure gradient within said channel for driving the air flow and for thinning the excess liquid.

11. An apparatus for removing excess liquid present on a surface of a liquid-developed image receptor, comprising:

a liquid-developed image receptor being movable in one direction at a predetermined velocity; and means for effecting air flow in a direction substantially parallel to and opposite the direction of movement of said image receptor, said air flow being effected at a velocity greater than the velocity of movement of said image receptor, said effecting means applying a shearing action to a surface of said image receptor to remove any excess liquid present thereon, said effecting means being self-compensating so that dimensions of paths through which said air flow is effected can be varied without affecting the applied shearing action.

12. The apparatus as recited in claim 11, wherein:

said means for effecting air flow comprises a positive pressure device.

13. The apparatus as recited in claim 11, wherein:

said means for effecting air flow comprises a vacuum device.

14. The apparatus as recited in claim 13, wherein:

said vacuum device is connected to a collection reservoir.

15. The apparatus as recited in claim 11, wherein:

said effecting means creates a pressure gradient in said channel for driving the air flow and for thinning the excess liquid.

16. A method for removing excess liquid present on a surface of a liquid-developed image receptor, comprising the steps of:

moving a liquid-developed image receptor in one direction at predetermined velocity;

effecting air flow in a direction substantially parallel to and opposite that of said image receptor movement, said effecting being performed in predefined channels at a velocity greater than the velocity of movement of said image receptor, said effecting applying a shearing action to a surface of said receptor for removing any excess liquid present thereon, said effecting being performed in a self-compensating manner such that dimensions of said predefined channels through which said air flow is effected can be varied without affecting the applied shearing action.

17. The method as recited in claim 16, further comprising:

positioning a positive air-pressure source adjacent said receptor surface to cause said air flow to be effected.

18. The method as recited in claim 16, further comprising:

positioning a vacuum adjacent to said receptor surface to cause said air flow to be effected.

19. The method as recited in claim 18, further comprising:

collecting the excess liquid removed by the air flow.

20. The method as recited in claim 16, further comprising:

providing a channel adjacent said receptor surface through which said air flow is effected, and creating a pressure gradient within said channel for driving the air flow and for thinning the excess liquid.

* * * * *